US007925187B2

(12) United States Patent
Izutani et al.

(10) Patent No.: US 7,925,187 B2
(45) Date of Patent: Apr. 12, 2011

(54) DEVELOPMENT DEVICE, IMAGE FORMING APPARATUS AND DEVELOPMENT METHOD

(75) Inventors: Akira Izutani, Takatsuki (JP); Minoru Nakamura, Mishima (JP)

(73) Assignee: Ricoh Company Limited, Tokyo (JP)

( * ) Notice: Subject to any disclaimer, the term of this patent is extended or adjusted under 35 U.S.C. 154(b) by 112 days.

(21) Appl. No.: 12/325,001

(22) Filed: Nov. 28, 2008

(65) Prior Publication Data

US 2009/0142107 A1 Jun. 4, 2009

(30) Foreign Application Priority Data

Nov. 29, 2007 (JP) ..... 2007-308163
Dec. 19, 2007 (JP) ..... 2007-326729

(51) Int. Cl.
*G03G 15/08* (2006.01)

(52) U.S. Cl. ..... 399/253; 399/284

(58) Field of Classification Search ..... 399/98, 399/99, 252, 253, 254, 272, 274, 281, 284
See application file for complete search history.

(56) References Cited

U.S. PATENT DOCUMENTS 5,153,642 A * 10/1992 Folkins et al. ..... 399/253
5,708,939 A * 1/1998 Oikawa et al. ..... 399/252
7,027,758 B2 * 4/2006 Miyakawa et al. ..... 399/252 X
7,251,441 B2 * 7/2007 Hagiwara et al. ..... 399/274 X
7,596,331 B2 * 9/2009 Kinokuni ..... 399/354 X
2006/0204882 A1 9/2006 Nozaki et al.
2006/0210902 A1 9/2006 Nakamura et al.
2006/0275686 A1 12/2006 Kadota et al.
2007/0059625 A1 3/2007 Yamamoto et al.
2007/0166635 A1 7/2007 Yamamoto et al.
2007/0190442 A1 8/2007 Nakamura et al.
2007/0207399 A1 9/2007 Kadota et al.
2007/0218384 A1 9/2007 Matsumoto et al.
2007/0218393 A1 9/2007 Nozaki et al.
2008/0038656 A1 2/2008 Yasunaga et al.

FOREIGN PATENT DOCUMENTS

JP 58-223158 12/1983
JP 7-168393 7/1995
JP 2001-255737 9/2001
JP 2005-189405 7/2005
JP 3914766 2/2007

* cited by examiner

*Primary Examiner* — Sandra L Brase
(74) *Attorney, Agent, or Firm* — Oblon, Spivak, McClelland, Maier & Neustadt, L.L.P.

(57) ABSTRACT

A development device including a development roller to bear a development agent including toner, a development agent supplying roller which is provided adjacent to the development roller to supply the development agent to the development roller, a regulation applicator to regulate the layer thickness of the development agent on the development roller and a capture device to capture the development agent finely powdered by the regulation applicator.

16 Claims, 5 Drawing Sheets

DEVELOPMENT DEVICE, IMAGE FORMING APPARATUS AND DEVELOPMENT METHOD

BACKGROUND OF THE INVENTION

1. Field of the Invention

The present invention relates to a development device, an image forming apparatus and a development method.

2. Discussion of the Background

In general, an image forming apparatus such as a photocopier, a printer, a facsimile machine or a multi-function apparatus thereof has a configuration in which paper accommodated in a paper cassette is transferred to a paper path where an image is printed on the paper and discharged to a discharging tray.

The development devices for use in an image forming apparatus such as an electrophotographic photocopier or an electrophotographic printer are typified into a two component development device using a development agent including a carrier and a toner and a single component development device using a development agent including only a toner. Demands with regard to the image forming apparatus from the market are, for example, size reduction, low manufacturing cost, improvement on the quality of images, high speed performance, etc. A single component development agent is preferably used.

A single component development device is well known which includes a development roller which is arranged adjacent to a latent electrostatic image bearing member and bears a toner as a single component development agent, a development agent supply roller to supply toner to the development roller, and a regulation applicator which is brought in contact with the surface of the development roller to regulate the layer thickness of the toner on the development roller (refer to unexamined published Japanese patent application No. (hereinafter referred to as JOP) 2001-255737).

A magnetic single component development agent (toner) and a non-magnetic single component development agent (toner) are used as the single component development agent for use in the single component development device. As described in JOP S58-223158, since the magnetic single component development agent is easily attached to the surface of the development roller by a magnetic attraction force, there is a wide latitude with regard to the supply direction of the toner and also a wide designing latitude with regard to the designing of the development device itself and the arrangement thereof in a photocopier. However, since a magnetite prescribed as a magnetic component in the magnetic single component development agent has its own inherent color of blue or brown, toner for black can be manufactured for photocopying but no toner for cyan, magenta or yellow can be suitably manufactured. In addition, the mixed color obtained at image fixing is not perfectly the original color because the inherent color of magnetite is reflected at color mixture.

On the other hand, the non-magnetic single component development agent is only formed of resin components, which is advantageous to manufacture pure cyan, magenta, or yellow color toner for color images. However, since the toner is not attracted to the development roller by a magnetic attraction force, the toner is supplied to the surface of the development roller by making the toner in contact with the development roller under a significantly constant pressure. That is, the toner layer is formed on the surface of the roller by interaction such as Coulomb's force or van del Waals's force based on triboelectrical charge. Therefore, the supply direction of toner to the development roller is limited in some degree and the designing latitude is narrow.

That is, the toner in the non-magnetic single component development system is necessary to be regulated under a significantly constant pressure applied by, for example, a metal blade. This causes a problem that while a development device is used for an extended period of time, some of the toner is adhered to the blade, which easily prevents the toner from forming a uniform thin layer on the surface of the roller. To be specific, streaks are formed on the thin layer of the toner on the development roller along the rotation direction thereof and reflected on an image. This means that the non-magnetic single component development method involves with the image degradation problem caused by adhesion of toner to the regulation applicator such as a blade.

The toner adhesion to a regulation applicator is caused, for example, in such a manner that fine powder toner having a smaller particle diameter than the average particle diameter of the toner accumulates on the regulation applicator (blade) and adheres thereto in due time while the fine powder toner is abraded by the regulation applicator. The fine powder toner is produced when toner which has passed through the regulation applicator is under a great stress such that the toner is abraded between the regulation applicator and the development roller and resultantly cracks and/or is chipped off. The toner particles have a particle diameter with a distribution in a particular range and fine powder toner having a small particle diameter is known to have a relatively small amount of charge in comparison with that of toner having an average particle diameter. The fine powder toner having a small amount of charge which is produced when the toner passes the regulation applicator tends not to be used for development of an image on an image bearing member but to remain on the surface of the development roller. The fine powder toner remaining on the surface of the development roller is collected at (transferred to) the toner supply roller portion, accumulated around the toner supply roller and supplied again to the regulation applicator. The fine powder toner produced by cracking or chipping-off contains wax, a pigment, a dispersion agent, a charge control agent in a large amount. It is known that as the amount (ratio) of the fine powder toner increases, the fluidity of the toner decreases. The fine powder toner, which has a small amount of charge and a low fluidity, tends to accumulate at the nip portion where the toner is nipped between the development roller and the regulation applicator for an extended period of time, which is the main cause of the adhesion of the toner to the regulation applicator.

The non-magnetic single component development agent has another problem, which is the non-magnetic single component development agent is directly adhered to the regulation applicator under a great amount of pressure thereby. However, for example, JOP 2001-255737 describes solutions to this problem, which are controlling the regulation pressure to toner by a regulation applicator to avoid a great pressure, applying a bias having the same polarity as that of toner to prevent the toner from adhering to the regulation applicator (blade), etc.

As a method of preventing the adhesion of fine powder toner to the regulation applicator, JOP H07-168393 describes a method in which fine powder toner having a particle diameter of 5 μm or smaller is controlled to be 2% or less by volume distribution when manufacturing toner.

In addition, JOP 2005-189405 describes a configuration in which a rotation brush is arranged in contact with the development roller to generate an electric field. When a rotation brush having a low implant density is used, all the toner including fine powder toner in the development device may be captured. Therefore, a rotation brush having a high implant density is preferably used.

However, in recent years, development of a compact-sized apparatus capable of producing images at a high speed has been demanded. To meet this demand, the pressure applied to toner by a regulation applicator increases so that the adhesion problem of toner to the regulation applicator still remains unsolved because fine powder toner is newly produced under the pressure by a regulation applicator after fine powder toner produced in the process of manufacturing toner is removed as described in JOP H07-168393. The fine powder toner produced in the development device has a large impact in comparison with the fine powder toner contained at the manufacturing stage. Especially the fine powder toner has an adverse impact in an environment of high temperature and a high humidity.

As described above, the fine powder toner newly produced in a development device is produced when the toner cracks under a great pressure from a regulation applicator. External additives are not attached to the new surface of the cracked toner. Isolated external additives in toner can be attached to the new surface but does not impart the fine powder toner with a sufficient attachment property. Therefore, the fine powder toner newly produced in a development device has a low chargeability in comparison with fine powder toner produced when manufacturing toner and a strong attachment property to a regulation applicator when compared with a toner to which external additives are regularly attached.

In addition, the method described in JOP 2005-189405 decreases the amount of the fine powder toner by the rotation brush but not to a sufficient level.

SUMMARY OF THE INVENTION

Because of these reasons, the present inventors recognize that a need exists for a development device and a development method using a non-magnetic single component development agent (toner) which prevent adhesion of the toner to the regulation applicator for an extended period of time.

Accordingly, an object of the present invention is to provide a development device and a development method using a non-magnetic single component development agent (toner) which prevent adhesion of the toner to the regulation applicator for an extended period of time.

Briefly this object and other objects of the present invention as hereinafter described will become more readily apparent and can be attained, either individually or in combination thereof, by a development device including a development roller to bear a development agent including toner, a development agent supplying roller which is provided adjacent to the development roller to supply the development agent to the development roller, a regulation applicator to regulate the layer thickness of the development agent on the development roller, and a capture device to capture the development agent finely powdered by the regulation applicator.

It is preferred that, in the development device, the capture device is a mesh having an opening diameter of 3 μm or smaller or a slit having an opening width of 3 μm or smaller.

It is still further preferred that, in the development device, the capture device is a fiber brush having an implant density of from 500,000 to 1,000,000 pieces of hair per inch$^2$.

As another aspect of the present invention, an image forming apparatus is provided which includes an image bearing member to bear a latent electrostatic image thereon and the development device described above to develop the latent electrostatic image with a development agent.

As another aspect of the present invention, a development method is provided which includes bearing a development agent including toner on a roller surface of a development agent supply roller in rotation, transferring the development agent from the development agent supply roller to the development roller abrasively adjacent thereto and triboelectrically charged by abrasion with a regulation applicator so that the development roller bears the development agent thereon, regulating a layer thickness of the development agent borne on the development roller with the regulation applicator, developing a latent electrostatic image on the image bearing member with the development agent borne on the development roller and capturing the development agent which is finely powdered by the regulation applicator with a capture device.

It is preferred that, in the development method, the capture device captures the toner having a particle diameter of 3 μm or smaller.

It is still further preferred that, in the development method, the regulation applicator has a regulation pressure of 30 N/m or higher.

It is still further preferred that, in the development method, the toner is manufactured by a pulverization method and has a volume average particle diameter of from 5 to 10 μm.

It is still further preferred that, in the development method, the toner is manufactured by a polymerization method and has a volume average particle diameter of from 4 to 8 μm These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention will be described below in detail with reference to several embodiments and accompanying drawings.

Figure 1:
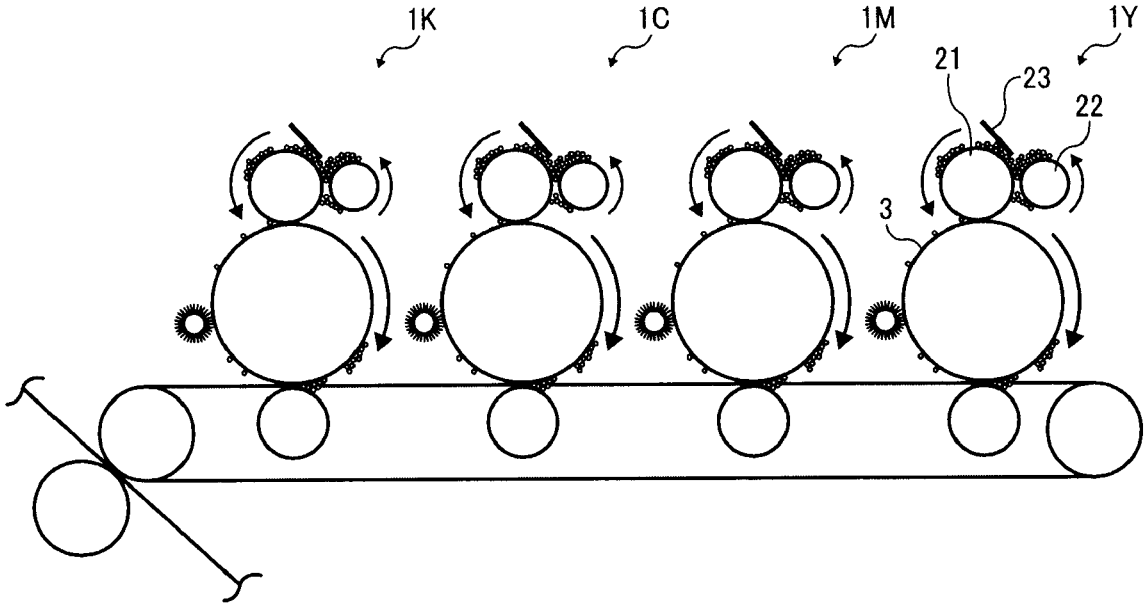
FIG. 1 is a schematic diagram illustrating an embodiment of the image forming apparatus of the present invention.

Below is a description about the basic structure of an image forming apparatus including an example of the development device of the present invention. FIG. 1 is a schematic diagram illustrating the portion of the development device contained in an image forming apparatus such as a photocopier, a facsimile machine or a printer. The image forming apparatus has four process units of 1Y, 1M, 1C and 1K to form toner images of yellow (Y), magenta (M), cyan (C) and black (K), respectively. Each of these process units 1Y, 1M, 1C and 1K has a development roller 21 which bears toner as the development agent, a toner supply roller 22 adjacent to the development roller 21 which supplies the toner to the development roller 21, a regulation blade 23 which regulates the toner on the development roller 21. The regulation blade can be formed of various kinds of materials such as metal or resin and can have a roller form as well. However, using a blade form is preferable in terms of size reduction.

Each of these process units 1Y, 1M, 1C and 1K also has also a photoreceptor drum 3 functioning as an image bearing member arranged adjacent to the development roller 21. The photoreceptor drum 3 includes, for example, an aluminum cylinder on which an organic photosensitive layer (photoconductive material) is formed. A photoreceptor having an amorphous silicon layer can be also used. In addition, an image bearing member having a belt form instead of a drum form can be also employed. A latent electrostatic image is recorded on the surface of the photoreceptor drum 3 and charged toner is attached to the recorded latent electrostatic image. The attached toner is transferred to an intermediate transfer body 4. The attached toner can be also directly transferred to a recording medium without using the intermediate transfer body 4.

The image formation method by the development device 2 having such a structure is schematically described below. Toner is borne on the roller surface of the toner supply roller 22 in rotation which supplies the toner. Next, the toner on the toner supply roller 22 is transferred to the development roller 21 which is triboelectrically charged by abrasion with the regulation blade 23 and regulated by the regulation blade 23. Then, the toner is transferred to the photoreceptor drum 3 adjacent to the development roller 21 to visualize the latent electrostatic image formed on the photoreceptor drum 3.

Figure 2:
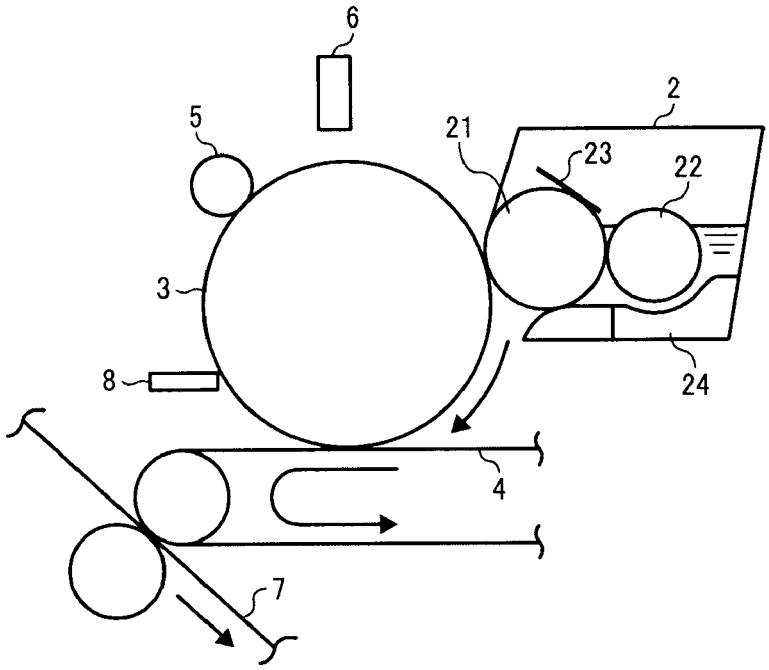
FIG. 2 is a schematic diagram illustrating an image forming apparatus including an embodiment of the development device of the present invention for a non-magnetic single component development agent.

FIG. 2 is a diagram illustrating part of an image forming apparatus including an example of the development device of the present invention for a non-magnetic single component development agent. A charging device 5 is adjacent to the photoreceptor drum 3 and charges the roller surface thereof. The charging device 5 can employ a non-contact type charging system as well as the roller charging system. An irradiation device 6 irradiates and scans the surface of the photoreceptor drum 3 already uniformly charged by the charging device 5 with light corresponding to image data for each color to form a latent electrostatic image on the roller surface of the photoreceptor drum 3. A bias is applied to the photoreceptor drum 3 and the development roller 21 so that the toner attaches to the latent electrostatic image written on the roller surface of the photoreceptor drum 3 at the contact portion of the development roller 21 and the photoreceptor drum 3 to develop and visualize the image. The toner attached to the roller surface of the photoreceptor drum 3 is transferred to the intermediate transfer body 4 and then to a recording medium 7 such as paper and thereafter fixed on the recording medium 7 by a heat fixing roller. After the toner contacts with the intermediate transfer body 4, only an extremely small amount of the toner on the latent electrostatic image on the photoreceptor drum 3 may remain thereon. The remaining toner is removed by a cleaning device 8 arranged in contact with the photoreceptor drum 3 and thereafter discarded. Toners manufactured by a pulverization method, polymerization method or other methods can be used as the toner for use in the present invention. Also, there is no specific limit to the material for use in the toner.

Figure 3:
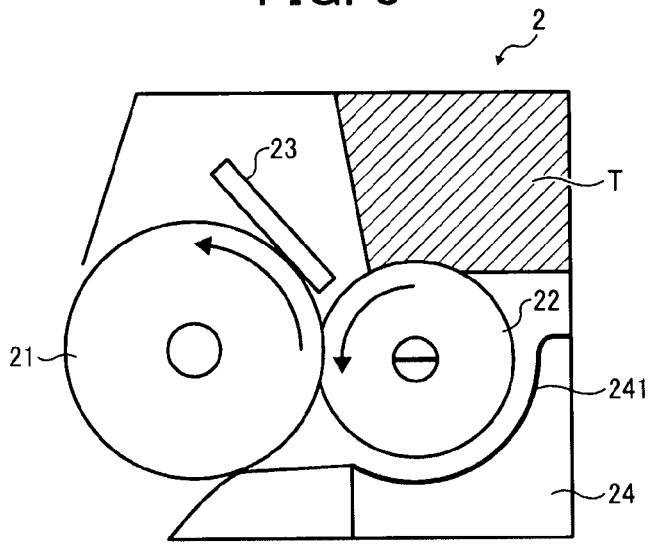
FIG. 3 is a diagram illustrating the inside structure of an example of the development device having a toner capture device.

FIG. 3 is a diagram illustrating the inside structure of the development device 2. In this figure, toner T in the vessel is accommodated in a toner cartridge, etc. There is no specific limit to the accommodation structure as long as the toner can be supplied to the toner supply roller 22. The toner supplied to the toner supply roller 22 advances into the nip portion where the toner is nipped by the toner supply roller 22 and the development roller 21. The development roller 21 rotates counterclockwise and the toner supply roller 22 also rotates counterclockwise, which produces friction force therebetween. Thus, the toner on the toner supply roller 22 is sufficiently transferred to the development roller 21. The ratio θ of the circumferential speed of the toner supply roller 22 to that of the development roller 21 is preferably from 0.6 to 2. When the ratio θ is too small, the toner is not sufficiently supplied to the development roller 21. In addition, when the toner does not sufficiently abrade with a container covering the toner supply roller 22, the toner may not be sufficiently charged. A ratio θ that is too large causes a torque that drives the toner supply roller 22 or the development roller 21 to increase, which causes another problem such as heat generation.

The toner transferred to the development roller 21 is regulated by the regulation blade 23 pressed against the development roller 21 to have a particular layer thickness. The pressure is preferably from 20 to 100 N/m. When the pressure is too small, the toner layer tends to be not sufficiently regulated or the toner tends to be not sufficiently charged. When the pressure is too large, the toner or the development roller 21 is under an excessive stress, which may cause deterioration of the toner performance. Furthermore, the toner tends to be adhered to the regulation blade 23, which causes deterioration of the quality of images. The pressure is preferably not less than 30 N/m. This is because, according to the demand for size reduction and high speed performance, the time of toner passing through the nip portion where the toner is nipped by the regulation blade 23 and the development roller 21 tends to decrease, which makes it difficult to charge the toner sufficiently under a low pressure.

The toner is charged to have a particular amount of charge by abrasion at the nip portion where the toner is nipped by the toner supply roller 22 and the development roller 21 and the contact portion between the regulation blade 23 and the development roller 21. In a system having no cleaning device, it is necessary to sufficiently remove the toner on the roller surface of the development roller 21 by the toner supply roller 22. Also, the charging property of the toner collected from the development roller 21 is required to be re-adjusted for re-use. To deal with this, the rotation number of the toner supply roller 22 is preferably set to be relatively large in comparison with the rotation number when a cleaning device is provided.

Furthermore, a bias voltage of a DC voltage, an AC voltage or an AC voltage overlapped with a DC voltage is suitably applied to the regulation blade 23 and the development roller 21 as a method of preventing the toner from attaching to the regulation blade 23. In addition, a bias is preferably applied to the toner supply roller 22 and the development roller 21 as well as the regulation blade 23 and the development roller 21 to improve the chargeability and collection of the toner.

Figure 11:
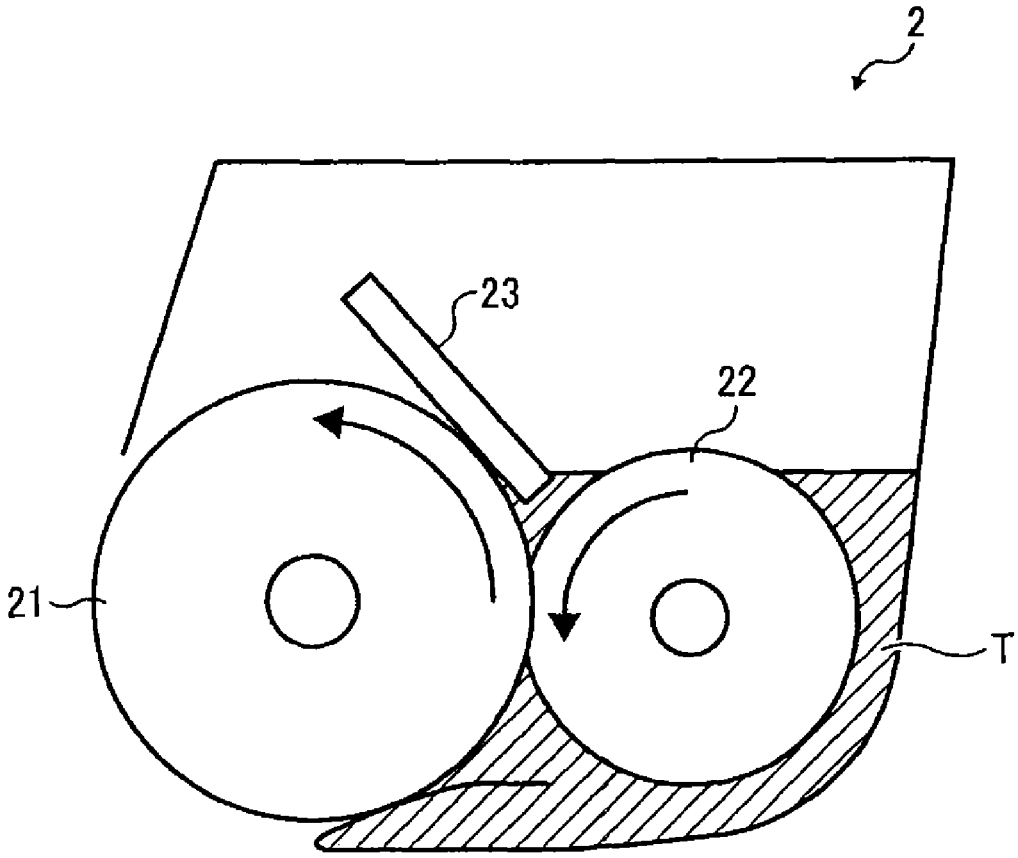
FIG. 11 PRIOR ART
FIG. 11 is a diagram illustrating the inside of a typical development device.

The development roller 2 has a toner collection portion 24 including a fine powder toner capture device (hereinafter referred to as toner capture device) 241 to capture fine powder toner. The position of capturing fine powder toner is not limited to the position illustrated in FIG. 3. The toner capture device is preferable to be arranged in a position where the toner collected from the development roller 21 to the development device 2 again can be efficiently trapped. Typically, a development device does not have a capture device as illustrated in FIG. 11.

Figure 4:
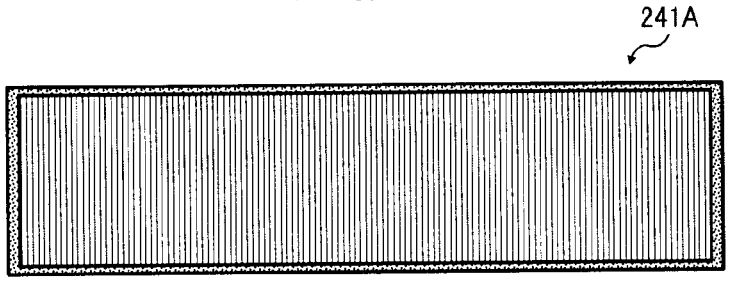
FIG. 4 is a diagram illustrating an example of the toner capture device.
Figure 5:
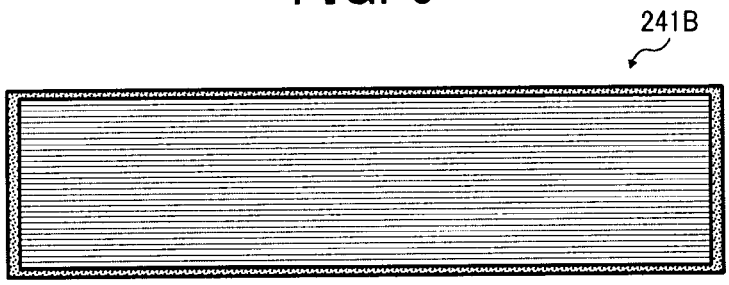
FIG. 5 is another diagram illustrating an example of the toner capture device.
Figure 6:
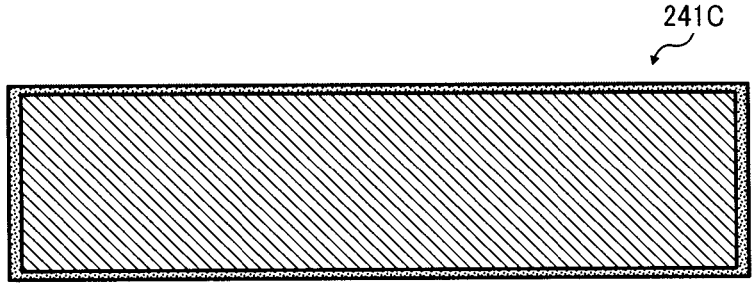
FIG. 6 is another diagram illustrating an example of the toner capture device.

A stainless metal having a thickness of 100 μm with a great number of holes having a diameter of 10 μm made by a laser processing can be used as the toner capture device 241. A bias voltage of DC 100 V having the same polarity as the regular charging polarity of the toner for use in image formation is applied to the toner capture device 241. The toner collection portion 24 where fine powder toner is captured can have a toner capture device having a different form such as 241A, 241B or 241 C having a slit form illustrated in FIGS. 4 to 6, respectively, or a toner capture device 241D having a mesh form illustrated in FIG. 7 instead of the toner capture device 241. The slit illustrated in the toner capture device 241A illustrated in FIG. 4 is formed along the direction from right to left with regard to FIG. 3. The longitudinal direction of the toner capture device 241A corresponds to the longitudinal direction of the toner supply roller 22. The slit of the toner capture device 241B illustrated in FIG. 5 is formed along the direction of the front to the rear with regard to FIG. 3, which corresponds to the longitudinal direction of the toner supply roller 22. The slit of the toner capture device 241C illustrated in FIG. 6 is formed in a slanted way. These toner capture devices 241A to 241 D having slits or meshes can be formed of metal fine lines having a surface coated with a resin. The opening width of the slit is preferably 3 μm or narrower to securely remove fine powder toner, thereby capturing fine powder toner having a dimension of the opening width or greater. That is, let alone fine powder toner having a particle diameter of not less than 3 μm, fine powder toner having a particle diameter less than 3 μm can be securely collected when the fine powder toner has a dimension of the opening width or greater.

Figure 8:
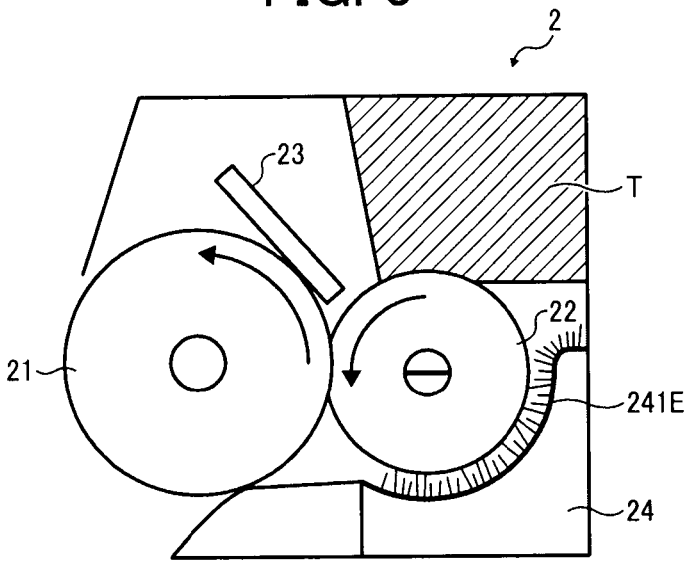
FIG. 8 is a diagram illustrating a variation example of the development device illustrated in FIG. 3.
Figure 9:
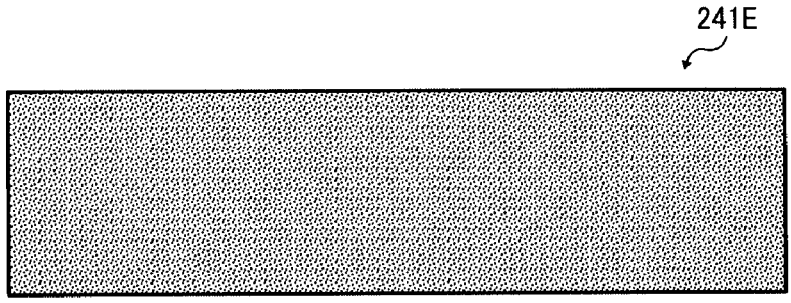
FIG. 9 is a diagram illustrating the toner capture device for use in the development device of FIG. 8.

FIG. 8 is a diagram illustrating a variation of the development device illustrated in FIG. 3. The development device 2 illustrated in FIG. 8 has a toner capture device having a different form from that illustrated in FIG. 3. A capture device 241E illustrated in FIGS. 8 and 9 is a fixed brush having a fiber brush made of polyamide, polyester, polypropylene, polytetrafluoroethylene, rayon, vinylon, or the like. The fiber brush is preferred to be subject to electroconductive treatment followed by an application of a bias to improve the capturing capability for fine powder toner.

The breadth of such fiber is preferably from 1 to 10 d (denier). When the breadth is excessively thin, the fiber tends to be thin and may be severed under stress, which degrades the fine powder capturing capability. In addition, manufacturing such a thin fiber is difficult. When the breadth is too thick, the fiber tends to be bread and wide and inflexible, which leads to difficulty in implantation of fiber with a high density. In addition, the implant density is preferably from 500,000 to 1,000,000 pieces of hair (fiber) per inch$^2$. When the implant density is too low, the capability of capturing fine powder toner deteriorates. An implant density that is too high makes implantation difficult.

In addition to the toner capture device 241 and 241A to 241E specified above, any toner capture device or member which can chemically or physically trap the toner can be used. For example, foam or non-woven fabric which traps toner physically can be suitably used. Also, an adhesive sheet can be used to chemically trap toner. Furthermore, these members and devices can be used in combination.

The toner for use in the development device 2 can be manufactured by a pulverization method or a polymerization method. When toner is manufactured by a pulverization method, the toner preferably has an average particle diameter ranging from 5 to 10 μm. When the average particle diameter is too small, a great amount of energy is required to pulverize toner particles, which is not preferred in terms of the protection of the environment. An average particle diameter that is too large tends to cause deterioration of the quality of images. When toner is manufactured by a polymerization method, the toner preferably has an average particle diameter ranging from 4 to 8 μm. An average particle diameter that is too small may cause a health problem for lung, etc. when the toner is inhaled. An average particle diameter that is too large tends to cause deterioration of the quality of images.

In the embodiments described above, since the toner capture device 241 or 241A to 241E traps fine powder toner scattering in the development device 2 accommodating the development roller 21 and the toner supply roller 22, toner particles are prevented from adhering to the regulation blade 23 for an extended period of time. Thus, good images can be formed for an extended period of time.

EXAMPLES

Example 1

Figure 7:
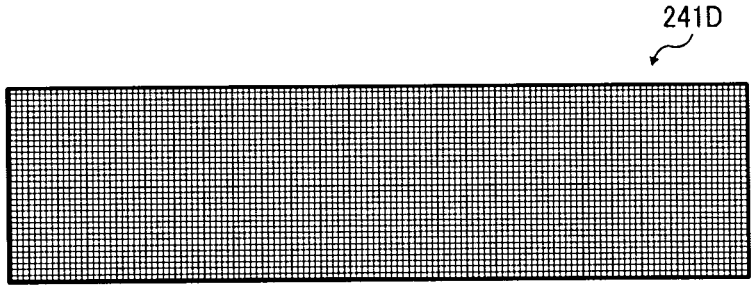
FIG. 7 is another diagram illustrating an example of the toner capture device.

The toner capture device 241D having an arch and mesh form illustrated in FIG. 7 is arranged in a development device for a non-magnetic single component development agent with the shortest distance from the roller surface of the toner supply roller 22 of 3 mm to have the configuration illustrated in FIG. 3. A bias is applied to the toner capture device 241D in such a manner that the voltage at the toner capture device 241D is 50 V lower than that of the toner supply roller 22.

In Example 1, black toner manufactured by a pulverization method which is negatively charged and has an average particle diameter of about 10 μm is filled in the development device and images are output on A4 plain paper using an image chart having a printing ratio of 5%. As a result, good images are produced from a start to at least 5,000th sheet.

Comparative Example 1

Images are produced in the same condition as in Example 1 except that the toner capture device for fine powder toner is removed from the development device. As a result, a bad image having a streak is observed at 2,500th image.

Example 2

The toner capture device 241E having a fiber brush of FIG. 9 is arranged in a development device for a non-magnetic single component development agent with the shortest distance from the roller surface of the toner supply roller 22 of 1 mm to have the configuration illustrated in FIG. 8. The fiber brush for use in the toner capture device 241E is an alamide fiber having electroconductivity with a fiber diameter of 2 d (denier), a fiber implant density of 550,000 pieces of hair per inch$^2$, and a hair length of fiber of 3 mm. A bias is applied to the toner capture device 241E in such a manner that the voltage at the toner capture device 241D is 50 V lower than that of the toner supply roller 22.

In Example 2, black toner manufactured by a polymerization method which is negatively charged and has an average particle diameter of about 7 μm is filled in the development device and images are output on A4 plain paper using an image chart having a printing ratio of 5%. As a result, good images are produced from a start to at least 5,000th sheet.

Example 3

The toner capture device 241E having a fiber brush of FIG. 9 is arranged in a development device for a non-magnetic single component development agent with the shortest distance from the roller surface of the toner supply roller 22 of 1 mm to have the configuration illustrated in FIG. 8. The fiber brush for use in the toner capture device 241E is an alamide fiber having electroconductivity with a fiber diameter of 2 d (denier), a fiber implant density of 800,000 pieces of hair per $inch^2$, and a hair length of fiber of 3 mm. A bias is applied to the toner capture device 241E in such a manner that the voltage at the toner capture device 241D is 50 V lower than that of the toner supply roller 22.

In Example 3, black toner manufactured by a polymerization method which is negatively charged and has an average particle diameter of about 7 μm is filled in the development device and images are output on A4 plain paper using an image chart having a printing ratio of 5%. As a result, good images are produced from a start to at least 5,000th sheet.

Comparative Example 2

Comparative Example 2 is performed in the same condition as in Example 2 except that the implant density of the fiber is changed to 150,000 pieces of hair per $inch^2$. As a result, a bad image having a streak is observed at 2,000th image.

Figure 10:
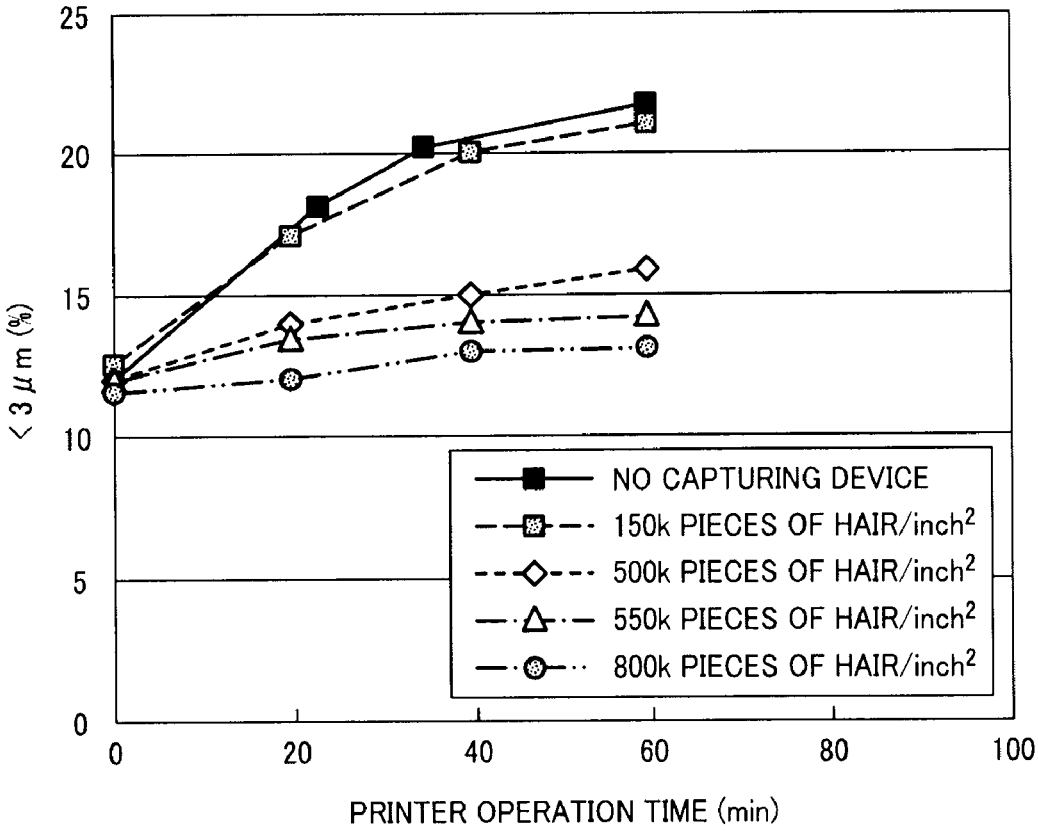
FIG. 10 is a graph illustrating the results of experiments in which the toner capture devices having fiber brush is used.

The amount of fine powder toner in the development device is measured to demonstrate the capture effect of fine powder toner by the fiber brush of Example 2 and Comparative Example 2. The results are shown in FIG. 10. As seen in FIG. 10, in the case in which the toner capture device is not present, the amount of fine powder toner having a particle diameter of 3 μm or smaller in the development device increases while outputting white solid images. In the case in which the fiber brush having an implant density of 150,000 pieces of hair per $inch^2$ is provided in the development device, the effect of capturing fine powder toner is hardly recognized. In the case in which the fiber brush having an implant density of 500,000 pieces of hair per $inch^2$ is provided in the development device, an increase of the fine powder toner in the development device is restrained. In Examples 2 and 3 in which the implant densities are 550,000 and 800,000 pieces of hair per $inch^2$, respectively, an increase of the fine powder toner in the development device is furthermore restrained, resulting in prevention of degradation of the quality of images.

This document claims priority and contains subject matter related to Japanese Patent Applications Nos. 2007-326729 and 2007-308163, filed on Nov. 29, 2007, and Dec. 19, 2008, respectively, the entire contents of which are) incorporated herein by reference.

Having now fully described the invention, it will be apparent to one of ordinary skill in the art that many changes and modifications can be made thereto without departing from the spirit and scope of the invention as set forth therein

What is claimed as new and desired to be secured by Letters Patent of the United States is:

1. A development device comprising:

a development roller configured to bear a development agent comprising toner;

a development agent supplying roller provided adjacent to the development roller, the development agent supplying roller configured to supply the development agent to the development roller;

a regulation applicator configured to regulate a layer thickness of the development agent on the development roller by applying a constant regulation pressure of 30 N/m or higher; and a capture device configured to capture the development agent which is finely powdered under the pressure from the regulation applicator;

wherein the capture device is a mesh having an opening diameter of 3 μm or smaller or a slit having an opening width of 3 μm or smaller.

2. The development device according to claim 1, wherein a bias voltage having the same polarity as the regular charging polarity of the toner is applied to the toner capture device.

3. The development device according to claim 1, wherein the the bias voltage applied to the toner capture device is 50 V lower than the voltage applied to the toner supply roller.

4. An image forming apparatus comprising:

an image bearing member configured to bear a latent electrostatic image thereon; and the development device of claim 1 configured to develop the latent electrostatic image with a development agent.

5. A development method comprising:

bearing a development agent comprising toner on a roller surface of a development agent supply roller in rotation;

transferring the development agent from the development agent supply roller to the development roller abrasively adjacent thereto and triboelectrically charged by abrasion with a regulation applicator so that the development roller bears the development agent thereon;

regulating a layer thickness of the development agent borne on the development roller with the regulation applicator by applying a constant regulation pressure of 30 N/m or higher;

developing a latent electrostatic image on the image bearing member with the development agent borne on the development roller; and capturing the development agent which is finely powdered under the pressure from the regulation applicator with a capture device;

wherein the capture device captures development agent having a article diameter of 3 μm or smaller.

6. The development method according to claim 5, wherein the toner is manufactured by a pulverization method and has a volume average particle diameter of from 5 to 10 μm.

7. The development method according to claim 5, wherein the toner is manufactured by a polymerization method and has a volume average particle diameter of from 4 to 8 μm.

8. The development method according to claim 5, wherein a bias voltage having the same polarity as the regular charging polarity of the toner is applied to the toner capture device.

9. The development method according to claim 8, wherein the bias voltage applied to the toner capture device is 50 V lower than the voltage applied to the toner supply roller.

10. A development device comprising:

a development roller configured to bear a development agent comprising toner;

a development agent supplying roller provided adjacent to the development roller, the development agent supplying roller configured to supply the development agent to the development roller;

a regulation applicator configured to regulate a layer thickness of the development agent on the development roller by applying a constant regulation pressure of 30 N/m or higher; and a capture device configured to capture the development agent which is finely powdered under the pressure from the regulation applicator;

wherein the capture device is a fiber brush having a fiber breadth of 1 to 10 denier and an implant density of from 500,000 to 1,000,000 pieces of hair per $inch^2$.

11. The development device according to claim 10, wherein the capture device is a fiber brush having an implant density of from 550,000 to 1,000,000 pieces of hair per $inch^2$.

12. The development method according to claim 11, wherein a bias voltage having the same polarity as the regular charging polarity of the toner is applied to the toner capture device.

13. The development method according to claim 12, wherein the bias voltage applied to the toner capture device is 50 V lower than the voltage applied to the toner supply roller.

14. The development device according to claim 10, wherein a bias voltage having the same polarity as the regular charging polarity of the toner is applied to the toner capture device.

15. The development device according to claim 14, wherein the bias voltage applied to the toner capture device is 50 V lower than the voltage applied to the toner supply roller.

16. An image forming apparatus comprising:

an image bearing member configured to bear a latent electrostatic image thereon; and the development device of claim 10 configured to develop the latent electrostatic image with a development agent.

* * * * *